US006685132B1

(12) United States Patent
Allen

(10) Patent No.: US 6,685,132 B1
(45) Date of Patent: Feb. 3, 2004

(54) WIRE STRINGING CART

(76) Inventor: T. Earl Allen, 16964 N. Main St., Jacksonville, FL (US) 32218

( * ) Notice: Subject to any disclaimer, the term of this patent is extended or adjusted under 35 U.S.C. 154(b) by 0 days.

(21) Appl. No.: 10/051,030

(22) Filed: Jan. 18, 2002

(51) Int. Cl.[7] ..... B65H 49/20
(52) U.S. Cl. ..... 242/557; 242/598.4
(58) Field of Search ..... 242/557, 598.3, 242/598.4, 403.1, 129.6, 129.62, 129.7, 129.71, 129.72; 280/47.17, 47.24; 248/129

(56) References Cited

U.S. PATENT DOCUMENTS

| | | | | | |
|---|---|---|---|---|---|
| 244,017 | A | * | 7/1881 | Zeigler | 242/129.6 |
| 1,693,877 | A | * | 12/1928 | Uttz, Sr. | 242/423 |
| 1,852,939 | A | * | 4/1932 | Schmidt | 242/396.6 |
| 2,155,769 | A | * | 4/1939 | Porter | 242/598.3 |
| 2,917,253 | A | | 12/1959 | Way | |
| 3,603,526 | A | * | 9/1971 | Payne et al. | 242/129.8 |
| 3,680,807 | A | | 8/1972 | Fortson | |
| 3,820,733 | A | | 6/1974 | Roederer | |
| 3,856,230 | A | * | 12/1974 | Zimmer | 242/422.8 |
| 3,990,653 | A | * | 11/1976 | Marcell | 242/129.8 |
| 4,114,391 | A | * | 9/1978 | Kahley, Sr. | 111/199 |
| D283,171 | S | | 3/1986 | Smith et al. | |
| 4,917,322 | A | | 4/1990 | Combs | |
| 5,102,154 | A | * | 4/1992 | McDonald | 280/47.27 |
| 5,285,981 | A | * | 2/1994 | Pavelka | 242/557 |
| 5,333,808 | A | * | 8/1994 | Klumpjan | 242/598.3 |
| 5,577,745 | A | * | 11/1996 | Birk | 280/47.19 |
| 5,667,163 | A | * | 9/1997 | Sordahl | 242/557 |
| 5,915,646 | A | | 6/1999 | Campbell | |

* cited by examiner

*Primary Examiner*—Kathy Matecki
*Assistant Examiner*—Scott J. Haugland

(57) ABSTRACT

A wire stringing cart for laying out wire in the making of a fence. The wire stringing cart includes a frame assembly designed to be a two-wheel cart with a crossbar member for holding a spool of wire that can be laid out as the cart is moved. The assembly also has a toolbox for housing the tools utilized in making a fence of this sort.

8 Claims, 3 Drawing Sheets

WIRE STRINGING CART

BACKGROUND OF THE INVENTION

1. Field of the Invention

The present invention relates to wire stringing devices and more particularly pertains to a new wire stringing cart for laying out wire in the making of a fence.

2. Description of the Prior Art

The use of wire stringing devices is known in the prior art. More specifically, wire stringing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,820,733; U.S. Pat. No. 5,915,646; U.S. Pat. No. 2,917,253; U.S. Pat. No. 3,680,807; U.S. Pat. No. Des. 283,171; and U.S. Pat. No. 4,917,322.

While these devices fulfill their respective, particular objectives and requirements, the aforementioned patents do not disclose a new wire stringing cart. The inventive device includes a frame assembly designed to be a two-wheel cart with a crossbar member for holding a spool of wire that can be laid out as the cart is moved. The assembly also has a toolbox for housing the tools utilized in making a fence of this sort.

In these respects, the wire stringing cart according to the present invention substantially departs from the conventional concepts and designs of the prior art, and in so doing provides an apparatus primarily developed for the purpose of laying out wire in the making of a fence.

SUMMARY OF THE INVENTION

In view of the foregoing disadvantages inherent in the known types of wire stringing devices now present in the prior art, the present invention provides a new wire stringing cart construction wherein the same can be utilized for laying out wire in the making of a fence.

The general purpose of the present invention, which will be described subsequently in greater detail, is to provide a new wire stringing cart apparatus and method which has many of the advantages of the wire stringing devices mentioned heretofore and many novel features that result in a new wire stringing cart which is not anticipated, rendered obvious, suggested, or even implied by any of the prior art wire stringing devices, either alone or in any combination thereof.

To attain this, the present invention generally comprises a frame assembly designed to be a two-wheel cart with a crossbar member for holding a spool of wire that can be laid out as the cart is moved. The assembly also has a toolbox for housing the tools utilized in making a fence of this sort.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wire stringing cart apparatus and method which has many of the advantages of the wire stringing devices mentioned heretofore and many novel features that result in a new wire stringing cart which is not anticipated, rendered obvious, suggested, or even implied by any of the prior art wire stringing devices, either alone or in any combination thereof.

It is another object of the present invention to provide a new wire stringing cart which may be easily and efficiently manufactured and marketed.

It is a further object of the present invention to provide a new wire stringing cart which is of a durable and reliable construction.

An even further object of the present invention is to provide a new wire stringing cart which is susceptible of a low cost of manufacture with regard to both materials and labor, and which accordingly is then susceptible of low prices of sale to the consuming public, thereby making such wire stringing cart economically available to the buying public.

Still yet another object of the present invention is to provide a new wire stringing cart which provides in the apparatuses and methods of the prior art some of the advantages thereof, while simultaneously overcoming some of the disadvantages normally associated therewith.

Still another object of the present invention is to provide a new wire stringing cart for laying out wire in the making of a fence.

Yet another object of the present invention is to provide a new wire stringing cart which includes a frame assembly designed to be a two-wheel cart with a crossbar member for holding a spool of wire that can be laid out as the cart is moved. The assembly also has a toolbox for housing the tools utilized in making a fence of this sort.

Still yet another object of the present invention is to provide a new wire stringing cart that allows the user to lay out a wide variety of types of wire more efficiently.

Even still another object of the present invention is to provide a new wire stringing cart that provides for a place to keep all the necessary tool readily at hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
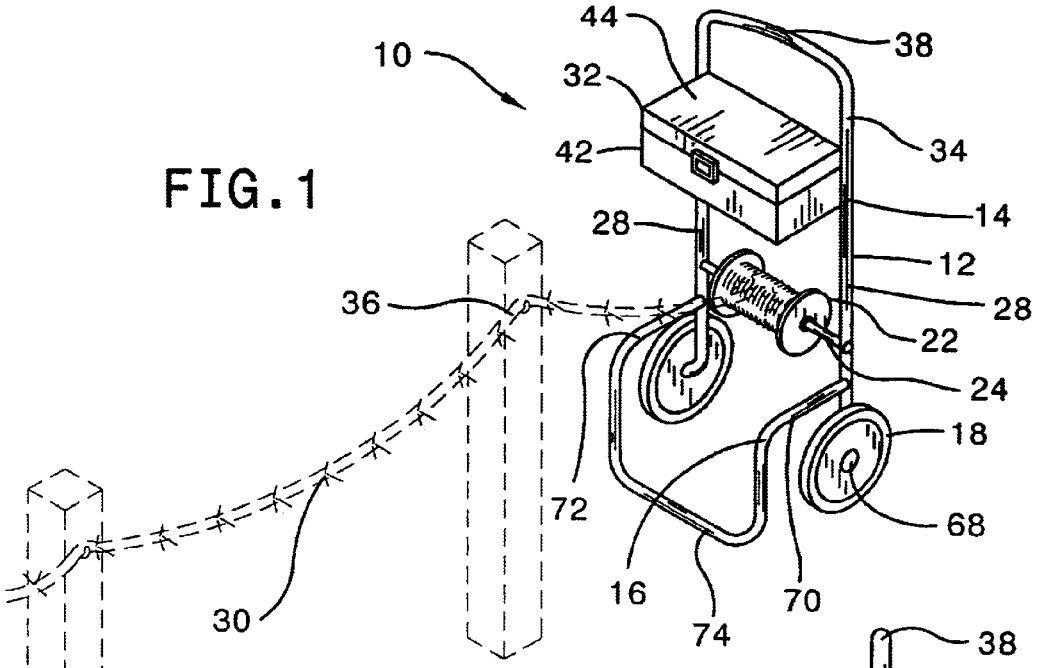
FIG. 1 is a perspective view of a new wire stringing cart in use according to the present invention.
Figure 3:
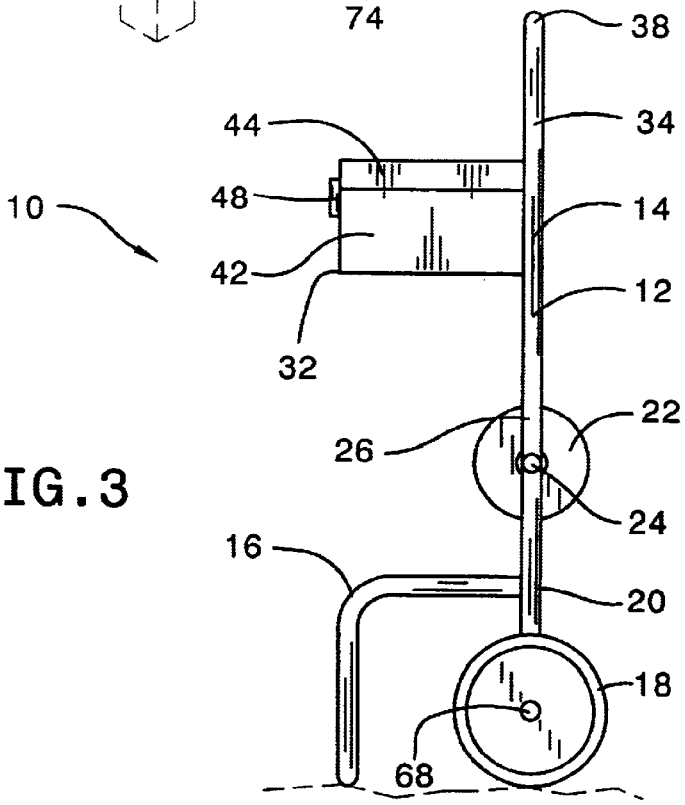
FIG. 3 is a side view of the present invention.
Figure 2:
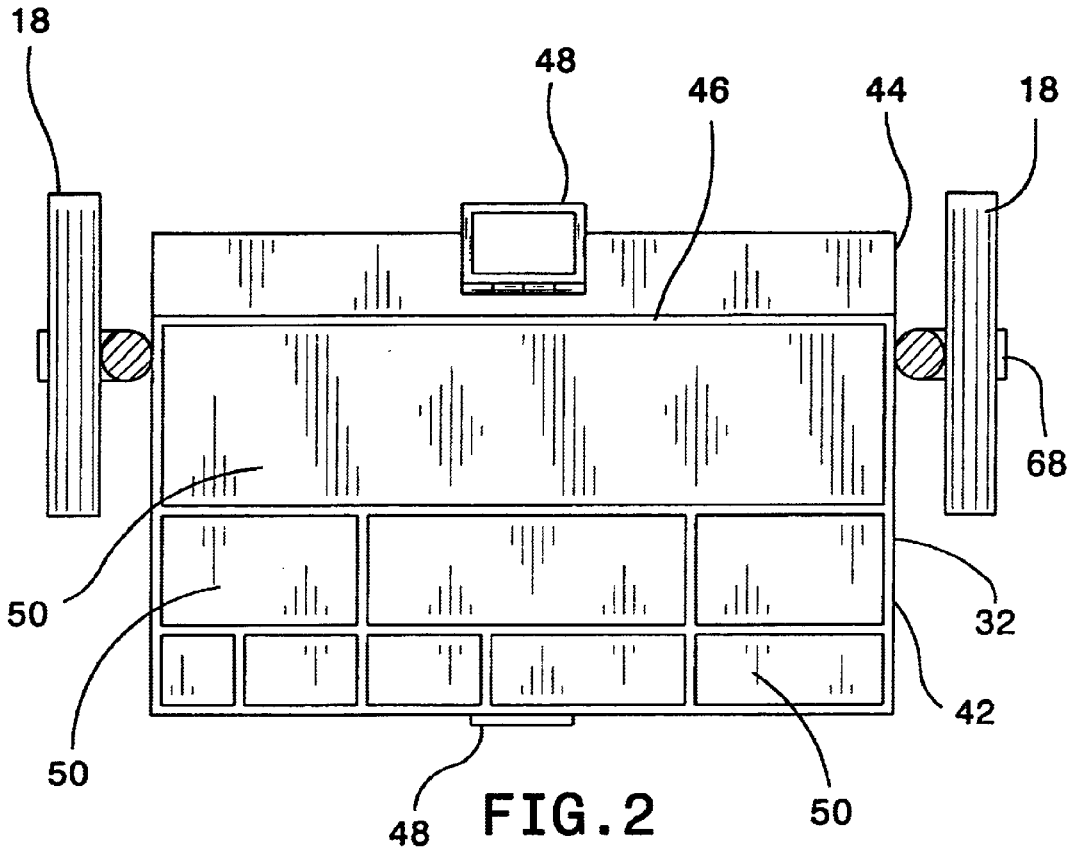
FIG. 2 is a top view of the present invention.
Figure 4:
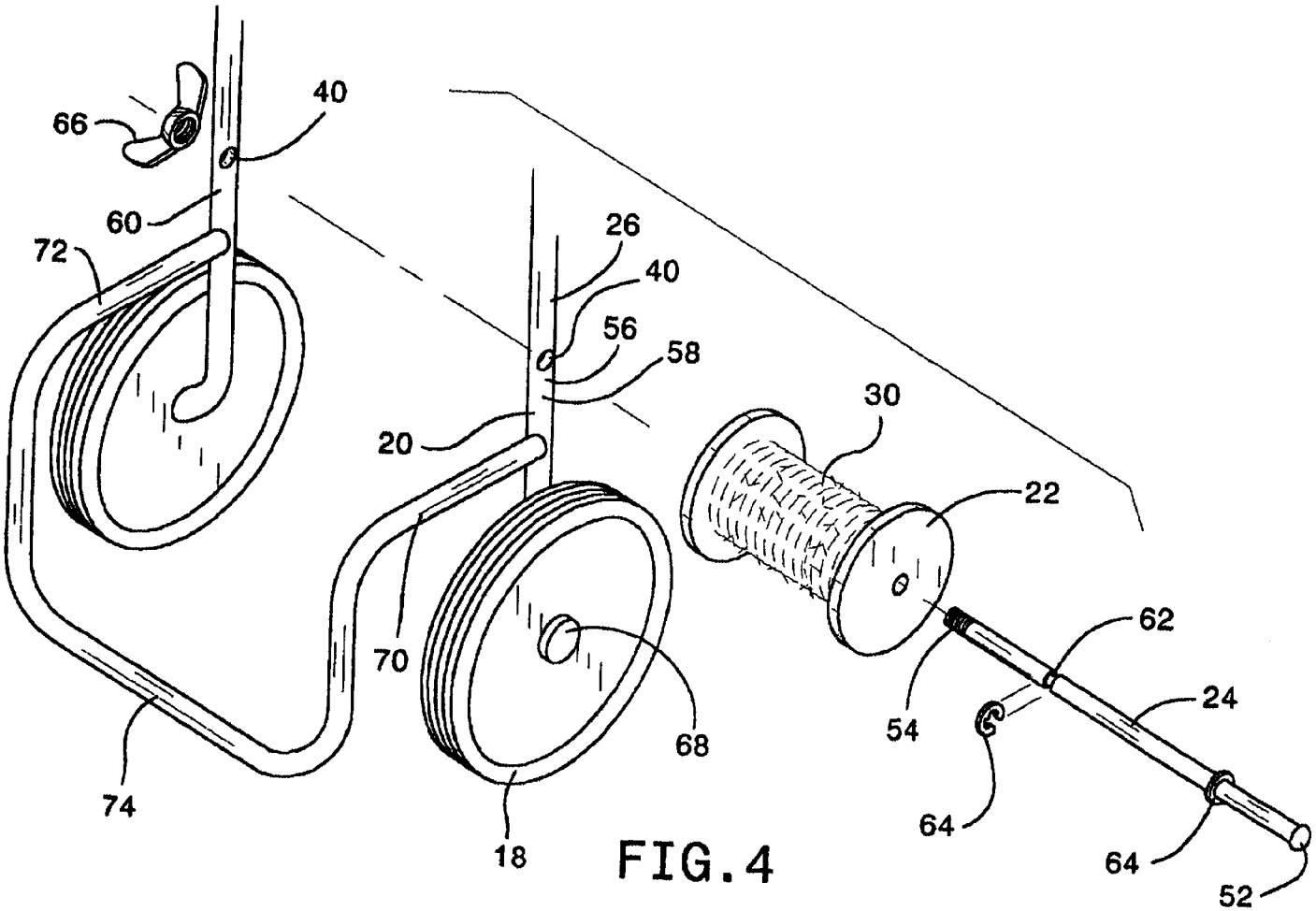
FIG. 4 is an exploded view of the lower portion of the present invention.

With reference now to the drawings, and in particular to FIGS. 1 through 4 thereof, a new wire stringing cart embodying the principles and concepts of the present invention and generally designated by the reference numeral 10 will be described.

As best illustrated in FIGS. 1 through 4, the wire stringing cart 10 generally comprises a frame assembly 12. The frame assembly 12 comprises a frame portion 14 and a brace portion 16. The frame portion 14 has a plurality of tire members 18. The brace portion 16 is fixedly coupled to a lower portion 20 of the frame portion 14 proximate the tire members 18. The frame assembly 12 is designed for resting firmly on the ground when the brace portion 16 and the tire members 18 are all in contact with the ground, and is movable when only the tire members 18 are in contact with the ground. This allows a user to move the frame assembly 12 as desired, then release the frame assembly 12 whereby the frame assembly 12 remains standing in a vertical position.

The frame portion 14 includes a spool member 22. The spool member 22 is selectively positioned on a spool rod member 24. The spool rod member 24 is selectively couplable to the frame portion 14 proximate medial portions 26 of side members 28 of the frame portion 14. The spool member 22 is freely rotatable about the spool rod member 24 for the purpose of dispensing barbed wire 30.

The frame portion 14 includes a toolbox member 32. The toolbox member 32 is fixedly coupled to the frame portion 14 proximate an upper portion 34 of the frame portion 14. The toolbox member 32 is designed for holding a plurality of tools associated with building a fence 36 utilizing barbed wire 30 or the like.

The frame portion 14 has a handle portion 38. The handle portion 38 is substantially unshaped. The handle portion 38 is integrally coupled to the side members 28 of the frame portion 14. The handle portion 38 is designed for grasping onto by the user thereby allowing the user to manipulate the frame assembly 12 as desired while building the fence 36.

Each of the side members 28 of the frame portion 14 has a bore 40. The bores 40 are located proximate the medial portion 26 of the side members 28 such that the bores 40 are designed for receiving the spool rod member 24.

The toolbox member 32 of the frame portion 14 is substantially rectangular in shape. The toolbox member 32 comprises a box portion 42 and a lid portion 44. The portions 42, 44 are hingably coupled along a common edge 46. The toolbox member 32 is closable thereby protecting the tools from the elements.

The toolbox member 32 includes a plurality of latch portions 48. The latch portions 48 are designed for securing the lid portion 44 and the box portion 42 of the toolbox member 32 together.

The box portion 42 of the toolbox member 32 has a plurality of compartments 50. The compartments 50 are positioned inside the toolbox member 32 such that the compartments 50 are designed for holding the tools.

The spool rod member 24 has a fixed end 52 and a threaded end 54. The fixed end 52 is designed for abutting an outer surface 56 of a first of the side members 58 when the spool rod member 24 is fully received by the bores 40 of the side members 28.

The threaded end 54 of the spool rod member 24 protrudes outwardly from an outer surface 56 of a second of the side members 60 when the spool rod member 24 is fully received by the side members 28. The spool rod member 24 is selectively couplable to the frame portion 14 when the spool rod member 24 is fully received by the side members 28 of the frame portion 14.

The spool rod member 24 has a plurality of grooves 62. The grooves 62 are positioned on the spool rod member 24 such that the grooves 62 are spaced at a distance greater than a width of the spool member 22.

The spool rod member 24 includes a plurality of retainer members 64. The retainer members 64 are positionable onto the grooves 62 thereby containing the spool member 22 between the retainer members 64 when the spool member 22 is positioned on the spool rod member 24 and spool rod member 24 is fully received by the side members 28 of the frame portion 14.

The spool rod member 24 includes a coupling member 66. The coupling member 66 is threadably couplable to the threaded end 54 of the spool rod member 24 such that the coupling member 66 is designed for selectively coupling the spool rod member 24 to the frame portion 14.

The tire members 18 of the frame portion 14 are rotatably couplable to axle portions 68 of the frame portion 14. The tire members 18 comprise a proportionally large pneumatic design such that the tire members 18 are designed for allowing the user to more efficiently move the frame assembly 12 across the ground.

The brace portion 16 of the frame assembly 12 comprises a first horizontal section 70 and a second horizontal section 72. The sections 70, 72 are oriented substantially transversely to a longitudinal axis of the frame portion 14. A resting portion 74 of the brace portion 16 is integrally coupled to the sections of the brace portion 16. The resting portion 74 is oriented substantially parallel to the longitudinal axis of the frame portion 14 and protrudes downwardly such that the brace portion 16 is designed for maintaining the frame assembly 12 in a vertical position when the tire members 18 of the frame portion 14 are in contact with the ground simultaneously.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A barbed wire stringing cart for laying out barbed wire in the making of a fence, the barbed wire stringing cart comprising:

a frame assembly, said frame assembly comprising a frame portion and a brace portion, said frame portion having a plurality of tire members, said brace portion being fixedly coupled to a lower portion of said frame portion proximate said tire members such that said frame assembly being adapted for resting firmly on the ground when said brace portion and said tire members all being in contact with the ground and movable when only said tire members being in contact with the ground thereby allowing a user to move said frame assembly as desired then release said frame assembly whereby said frame assembly remains standing in a vertical position;

said frame portion including a spool member, said spool member being selectively positioned on a spool rod member, said spool rod member being selectively couplable to said frame portion proximate medial portions of side members of said frame portion such that said spool member being freely rotatable about said spool rod member for the purpose of dispensing barbed wire; and said frame portion including a toolbox member, said toolbox member being fixedly coupled to said frame portion proximate an upper portion of said frame portion, said toolbox member being adapted for holding a plurality of tools associated with building a fence utilizing barbed wire;

each of said side members of said frame portion having a bore, said bores being located proximate said medial portion of said side members such that said bores being adapted for receiving said spool rod member;

said spool rod member having a fixed end and a threaded end, said fixed end being adapted for abutting an outer surface of a first of said side members when said spool rod member being fully received by said side members of said frame portion; and said threaded end of said spool rod member protruding outwardly from an outer surface of a second of said side members when said spool rod member being fully received by said bores of said side members such that said spool rod member being selectively couplable to said frame portion when said spool rod member being fully received by said bores of said side members;

said spool rod member having a plurality of grooves, said grooves being positioned on said spool rod member such that said grooves being spaced at a distance greater than a width of said spool member; and said spool rod member including a plurality of retainer members, said retainer members being positionable onto said grooves thereby containing said spool member between said retainer members when said spool member being positioned on said spool rod member and said spool rod member being fully received by said side members of said frame portion.

2. The barbed wire stringing cart as set forth in claim 1, further comprising:

said frame portion having a handle portion, said handle portion being substantially u-shaped, said handle portion being integrally coupled to said side members of said frame portion such that said handle portion being adapted for grasping onto by the user thereby allowing the user to manipulate said frame assembly as desired while building the fence.

3. The barbed wire stringing cart as set forth in claim 1, further comprising:

said toolbox member of said frame portion being substantially rectangular in shape, said toolbox member comprising a box portion and a lid portion, said portions being hingably coupled along a common edge, said toolbox member being closable thereby protecting the tools from the elements; and said toolbox member including a plurality of latch portions, said latch portions being adapted for securing said lid portion and said box portion of said toolbox member together.

4. The barbed wire stringing cart as set forth in claim 3, further comprising:

said box portion of said toolbox member having a plurality of compartments, said compartments being positioned inside said toolbox member such that said compartments being adapted for holding the tools.

5. The barbed wire stringing cart as set forth in claim 1, further comprising:

said spool rod member including a coupling member, said coupling member being threadably couplable to said threaded end of said spool rod member such that said coupling member being adapted for selectively coupling said spool rod member to said frame portion.

6. The barbed wire stringing cart as set forth in claim 1, further comprising:

said tire members of said frame portion being rotatably couplable to axle portions of said frame portion, said tire members comprising a proportionally large pneumatic design such that said tire members being adapted for allowing the user to more efficiently move said frame assembly across the ground.

7. The barbed wire stringing cart as set forth in claim 1, further comprising:

said brace portion of said frame assembly comprising a first horizontal section and a second horizontal section, said sections being oriented substantially transversely to a longitudinal axis of said frame portion, a resting portion of said brace portion being integrally coupled to said sections of said brace portion, said resting portion being oriented substantially parallel to said longitudinal axis of said frame portion and protruding downwardly such that said brace portion being adapted for maintaining said frame assembly in a vertical position when said tire members of said frame portion being in contact with the ground simultaneously.

8. A barbed wire stringing cart for laying out barbed wire in the making of a fence, the barbed wire stringing cart comprising:

a frame assembly, said frame assembly comprising a frame portion and a brace portion, said frame portion having a plurality of tire members, said brace portion being fixedly coupled to a lower portion of said frame portion proximate said tire members such that said frame assembly being adapted for resting firmly on the ground when said brace portion and said tire members all being in contact with the ground and movable when only said tire members being in contact with the ground thereby allowing a user to move said frame assembly as desired then release said frame assembly whereby said frame assembly remains standing in a vertical position;

said frame portion including a spool member, said spool member being selectively positioned on a spool rod member, said spool rod member being selectively couplable to said frame portion proximate medial portions of side members of said frame portion such that said spool member being freely rotatable about said spool rod member for the purpose of dispensing barbed wire;

said frame portion including a toolbox member, said toolbox member being fixedly coupled to said frame portion proximate an upper portion of said frame portion, said toolbox member being adapted for holding a plurality of tools associated with building a fence utilizing barbed wire or the like;

said frame portion having a handle portion, said handle portion being substantially u-shaped, said handle portion being integrally coupled to side members of said frame portion such that said handle portion being adapted for grasping onto by the user thereby allowing the user to manipulate said frame assembly as desired while building the fence;

each of said side members of said frame portion having a bore, said bores being located proximate said medial portion of said side members such that said bores being adapted for receiving said spool rod member;

said toolbox member of said frame portion being substantially rectangular in shape, said toolbox member comprising a box portion and a lid portion, said portions being hingably coupled along a common edge, said toolbox member being closable thereby protecting the tools from the elements;

said toolbox member including a plurality of latch portions, said latch portions being adapted for securing said lid portion and said box portion of said toolbox member together;

said box portion of said toolbox member having a plurality of compartments, said compartments being positioned inside said toolbox member such that said compartments being adapted for holding the tools;

said spool rod member having a fixed end and a threaded end, said fixed end being adapted for abutting an outer surface of a first of said side members when said spool rod member being fully received by said bores of said side members;

said threaded end of said spool rod member protruding outwardly from an outer surface of a second of said side members when said spool rod member being fully received by said bores of said side members such that said spool rod member being selectively couplable to said frame portion when said spool rod member being fully received by said side members of said frame portion;

said spool rod member having a plurality of grooves, said grooves being positioned on said spool rod member such that said grooves being spaced at a distance greater than a width of said spool member;

said spool rod member including a plurality of retainer members, said retainer members being positionable onto said grooves thereby containing said spool member between said retainer members when said spool member being positioned on said spool rod member and spool rod member being fully received by said side members of said frame portion;

said spool rod member including a coupling member, said coupling member being threadably couplable to said threaded end of said spool rod member such that said coupling member being adapted for selectively coupling said spool rod member to said frame portion;

said tire members of said frame portion being rotatably couplable to axle portions of said frame portion, said tire members comprising a proportionally large pneumatic design such that said tire members being adapted for allowing the user to more efficiently move said frame assembly across the ground;

said brace portion of said frame assembly comprising a first horizontal section and a second horizontal section, said sections being oriented substantially transversely to a longitudinal axis of said frame portion, a resting portion of said brace portion being integrally coupled to said sections of said brace portion, said resting portion being oriented substantially parallel to said longitudinal axis of said frame portion and protruding downwardly such that said brace portion being adapted for maintaining said frame assembly in a vertical position when said tire members of said frame portion being in contact with the ground simultaneously.

* * * * *